US006120376A

United States Patent [19]

Cherry

[11] Patent Number: 6,120,376

[45] **Date of Patent: *Sep. 19, 2000**

[54] WAGERING GAME BASED ON RANKING ORDER OF GAME PARTICIPANTS

[75] Inventor: Eric Cherry, Highland Beach, Fla.

[73] Assignee: Horse Sense Corporation, Delray Beach, Fla.

[ * ] Notice: This patent is subject to a terminal disclaimer.

[21] Appl. No.: 09/038,184

[22] Filed: Mar. 10, 1998

Related U.S. Application Data

[63] Continuation-in-part of application No. 08/886,193, Jul. 1, 1997, Pat. No. 5,957,775.

[51] Int. Cl.[7] ..... A63F 9/22

[52] U.S. Cl. ..... 463/16; 463/6; 463/20; 463/25; 463/27; 273/143 R; 273/139; 273/237; 273/256

[58] Field of Search ..... 463/6, 16, 20, 463/25, 27; 273/143 R, 256, 139, 246, 237

[56] References Cited

U.S. PATENT DOCUMENTS

| | | | |
|---|---|---|---|
| 4,373,723 | 2/1983 | Brown et al. | 273/86 |
| 4,962,950 | 10/1990 | Champion | 283/67 |
| 5,078,405 | 1/1992 | Jones et al. | 273/309 |
| 5,280,909 | 1/1994 | Tracy | 273/138 A |
| 5,374,060 | 12/1994 | Goldberg | 273/139 |
| 5,411,258 | 5/1995 | Wilson et al. | 273/86 |
| 5,513,103 | 4/1996 | Charlson | 364/411 |
| 5,564,701 | 10/1996 | Dettor | 463/16 |
| 5,564,977 | 10/1996 | Algie | 463/25 |
| 5,741,181 | 4/1998 | Nakagawa et al. | 463/6 |
| 5,823,872 | 10/1998 | Prather et al. | 463/6 |
| 5,957,775 | 9/1999 | Cherry | 463/16 |
| 5,997,400 | 12/1999 | Seelig et al. | 463/6 |

OTHER PUBLICATIONS

International Search Report dated Sep. 25,1998.

*Primary Examiner*—Jessica J. Harrison
*Assistant Examiner*—Carmen D. White
*Attorney, Agent, or Firm*—Fish & Richardson P.C.

[57] ABSTRACT

A wagering game for play by a player includes a set of game participants, an identification number assigned to each of the game participants, and a game number. The player places a wager relating to the game number, and a ranking order of the game participants is determined, such as by a race to a finishing point. The sum of the identification numbers of a subset of the game participants may be calculated. The number of lengths by which a first ordered game participant beats another ordered game participant to the finishing point may also be calculated. Whether the player's wager is a winning wager is determined by comparing the sum or the number of lengths to the game number. The wagering game may be implemented as an electronic game.

31 Claims, 4 Drawing Sheets

WAGERING GAME BASED ON RANKING ORDER OF GAME PARTICIPANTS

This is a continuation-in-part of application No. 08/886,193, now U.S. Pat. No. 5,957,775 filed Jul. 1, 1997.

BACKGROUND OF THE INVENTION

This invention relates to a wagering game, and in particular, a game in which wagers are placed with respect to a ranking order of game participants such as in a race.

A typical horserace includes, e.g., eight racing horses. Each horse is assigned a post number, e.g., 1 through 8. The horses race against each other to cross a finish line.

Game players place wagers that a particular race horse or a combination of race horses will finish the race in a particular order, e.g., first, second and third place. Bets are usually placed on the horses according to their post numbers. One standard bet involves guessing which three horses will cross the finish line first, second and third, respectively.

SUMMARY OF THE INVENTION

In general, in one aspect, the invention features a method of presenting one or more wagering games for play by a plurality of players. A set of game participants is selected, and an identification number is assigned to each of the game participants. A game number is selected, and each of the plurality of players places a wager relating to the game number, the sum of the wagers of the plurality of players being used to determine a total prize amount. A ranking order of the game participants is determined, and a sum of the identification numbers of a subset of the game participants selected on the basis of the ranking order of the game participants is calculated. Whether the wager of each of the plurality of players is a winning wager is determined by comparing the sum to the game number, and a payout for each winning player is determined based on the total prize amount, including having a progressive jackpot such that a portion of the total prize amount of a first game is added to wagers made during a second subsequent game to determine a total prize amount for the second game.

Implementations of the invention may include one or more of the following features. The subset may include at least two of the game participants. The payout may be determined on a parimutuel basis or based on predetermined odds.

The ranking order may be determined by a race. The wager may be that the sum is equal to, less than, or greater than the game number.

In general, in another aspect, the invention features a method of presenting a wagering game for play by a player. A set of game participants is selected to be ordered according to the finishing order of the participants with respect to a finishing point. A game number is selected, and the player places a wager relating to the game number. The finishing order of the game participants and the number of lengths by which a first ordered game participant beats at least one other ordered game participant to the finishing point are determined. Whether the player's wager is a winning wager is determined based on a comparison between the game number and the number of lengths.

Implementations of the invention may include one or more of the following features. The at least one other ordered game participant may be a second game participant to reach the finishing point.

The method may include providing a payout for a winning wager. The payout may be determined on a parimutuel basis or based on predetermined odds. The game may be played with a progressive jackpot such that a portion of a sum of wagers made during a first game is added to a sum of wagers made during a second subsequent game.

The finishing order may be determined by a race. The wager may be that the number of lengths is equal to, less than, or greater than the game number.

In general, in another aspect, the invention features an electronic gaming device for playing a wagering game by a player. A display device displays a game number and a set of game participants. An input device allows the player to place a wager relating to the game number. A processor connected to the display device and the input device determines a finishing order of the game participants and a number of lengths by which a first ordered game participant beats at least one other ordered game participant to the finishing point. The processor determines whether the wager is a winning wager by comparing the number of lengths to the game number.

Implementations of the invention may include one or more of the following features. The display device may include a screen, and the input device may include buttons or a touch sensitive screen. The gaming device may be connected to other gaming devices for parimutuel wagering.

The processor may calculate a payout to the player for a winning wager and provide the payout. The payout may be determined on a parimutuel basis or based on predetermined odds. The payout calculated by the processor may include a progressive jackpot such that a portion of a sum of wagers made during a first game is added to a sum of wagers made during a second subsequent game.

The finishing order may be determined by a race. The wager may be that the number of lengths is equal to, less than, or greater than the game number.

The wagering game of the present invention has the advantage that it is a simple game that can be played along with other standard wagering games.

The wagering game of the present invention has the further advantage of allowing players to place wagers on combinations of known probabilistic events.

Other features and advantages of the invention will become apparent from the following detailed description, and from the claims.

DESCRIPTION OF THE PREFERRED EMBODIMENTS

The wagering game of the present invention involves, e.g., the game players placing wagers with respect to the post numbers of the racing horses.

Figure 1:
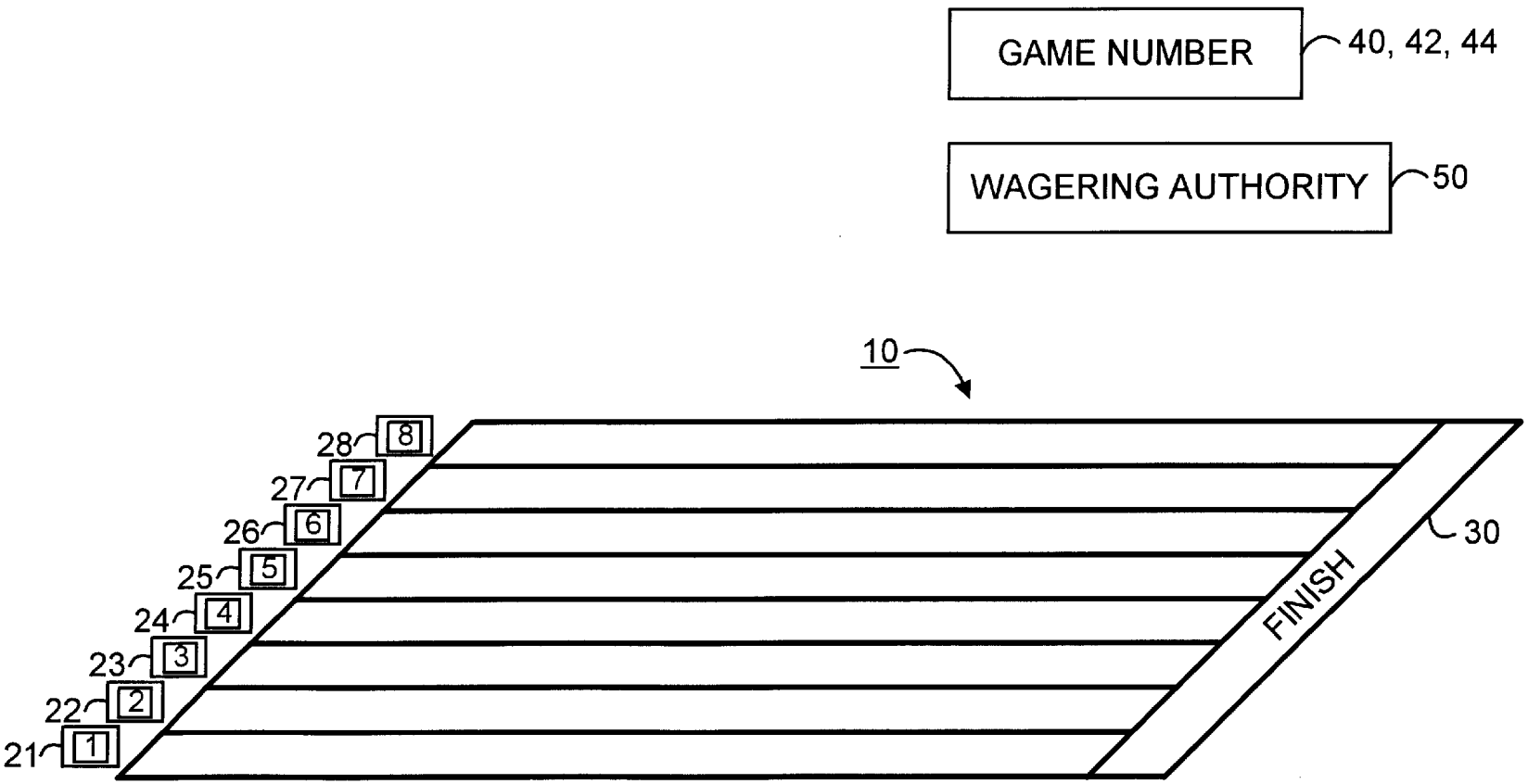
FIG. 1 shows a horserace wagering game according to the present invention.

As shown in FIG. 1, game 10 includes game participants 21–28. Participants 21–28 compete against each other to reach a finishing point 30. In the example described herein, the game participants 21–28 are racing horses racing against each other to cross a finish line 30.

The first game participant to reach finishing point 30 beats each of the other participants which subsequently reach finishing point 30 by a number of "lengths." The lengths may be based on the physical dimensions, i.e. lengths, of the game participants. For example, the first racing horse to cross finish line 30 may beat the second racing horse to finish line 30 by a particular number of horselengths. The number of lengths may be recorded for each game participant in each game.

Each of game participants 21–28 is assigned an identification number. For example, race horses 21–28 are assigned identification numbers in the form of post numbers 1–8, respectively.

The wagering game of the present invention also includes choosing a game number 40. Game number 40 is a number chosen artificially, e.g., based on a statistical analysis of the probabilistic outcomes of the game being played. In particular, game number 40 may be chosen with respect to the identification numbers of the game participants and the likely ranking order of the game participants in reaching the finishing point 30. The game number 40 may be different for every race.

The game players place wagers with a wagering authority 50 concerning the mathematical relationship of the identification numbers 1–8 of the participants 21–28 to the game number 40. In a preferred embodiment, the game players place wagers that the sum of the identification numbers of the first three game participants to reach the finishing point 30 will be greater than, less than, or equal to the game number 40. Payouts may be provided for winning wagers by wagering authority 50.

For example, prior to the start of a horserace, when players may place wagers, a game number, e.g. 15, is chosen by the wagering authority 50. Players guess the finishing order of the racing horses, each of which is assigned a post number from 1 through 8. Each player then adds the post numbers of the three racing horses that he believes will be the first, second and third horses to cross the finish line 30 during the race. If the player guesses that racing horses 22, 25 and 27 will be the first three racing horses to cross finish line 30, the sum of the post numbers for these horses is 2+5+7=14. Thus, the player may wish to place a wager that the sum of the post numbers of the first three horses to cross the finish line during the race will be less than the game number, since 14 is less than 15.

In this example, if horses 22, 25 and 27 are the first three horses to cross the finish line, then the player's wager that the sum of the post numbers of the first three horses to cross the finish line will be less than 15 is a winning wager. If horses 21, 25 and 27 are the first three horses to cross the finish line, then the player's wager that the sum of the post numbers (1+5+7=13) of the first three horses to cross the finish line will be less than 15 is still a winning wager. However, if horses 25, 26 and 27 are the first three horses to cross the finish line, then the player's wager that the sum of the post numbers (5+6+7=18) of the first three horses to cross the finish line will be less than 15 is not a winning wager.

An additional wager that may be used with the wagering game of the present invention involves each player placing a wager with respect to a game number 42 chosen by the wagering authority and guessing by how many lengths the first game participant to reach finishing point 30 will beat the second game participant which reaches finishing point 30. The game number 42, which is chosen prior to start of each wagering game, may be different for every game and may be chosen based on the likely number of lengths by which the winning game participant will win the race. For example, to use such a wager to play the game, a player places a wager based on the number of horselengths by which the first racing horse to reach the finish line will beat the second racing horse which reaches the finish line, such as whether that number of horselengths is greater than, less than or equal to game number 42.

Another similar wager involves each player placing a wager with respect to a game number 44 chosen by the wagering authority and guessing the difference between the number of lengths by which any two game participants are beaten to finishing point 30 by the first game participant to reach finishing point 30. The game number 44, which is chosen prior to start of each wagering game, may be different for every game and may be chosen based on the likely number of lengths by which the winning game participant will beat each of the other game participants to finishing point 30. The number of lengths by which a particular game participant is beaten to the finish line by the winning participant may be termed that game participant's "score." For example, to use such a wager to play the game, a player places a wager based on the difference of the scores between any two game participants, such as the second and third place finishing horses, such as whether that difference is greater than, less than or equal to game number 44.

Payouts to winning players may be determined on a parimutuel basis. A parimutuel wagering scheme includes a betting pool in which players who bet on game participants finishing in the first predetermined number of places share the total amount bet by all players, minus a percentage retained by the wagering authority. Such a scheme allows payouts to winning players to change throughout the period of time when wagers may be placed, while the players are placing their wagers. The payout to players who place winning wagers depends on the number of players that place winning wagers and the number of players that place non-winning wagers.

In such a parimutuel wagering scheme, players may be apprised of the changing payouts for the various possible wagers throughout the period of time when wagers may be placed. In particular, the payout to a player for a winning wager may be determined at the time the wager is placed. Accordingly, payouts will be higher for wagers that are chosen by fewer players than those chosen by the other remaining players. Thus, players are encouraged to place wagers on the less popular wagers that provide higher payouts. Such a scheme tends to stabilize the payout to players that place winning wagers because the players' wagers are more evenly distributed among the possible wagers.

Alternately, payouts to winning players may be based on predetermined odds that do not change during the period of time when wagers may be placed.

In a preferred embodiment, the wagering game of the present invention is played with a progressive jackpot. For a progressive jackpot, at least a portion of the wagers paid in one game is carried over to the next consecutive game played to be added to the wagers made in the next game to increase the total prize payable to the winning players of the next game. For example, if there is no winner of a game, a portion of the sum of all wagers placed may be added to the wagers placed in the next consecutive game to increase the total prize money available to winning players of the next game, until a final game is played. With a progressive jackpot scheme, the total prize payable to winning players has the potential to increase substantially with each consecutive game played in a series of games, increasing the players' interest in the game.

The wagering game of the present invention may be applied to any order-dependent participation game such as a racing game, or any ranking scheme including a series of sporting events for sports teams such as football, soccer and basketball games.

Figure 2:
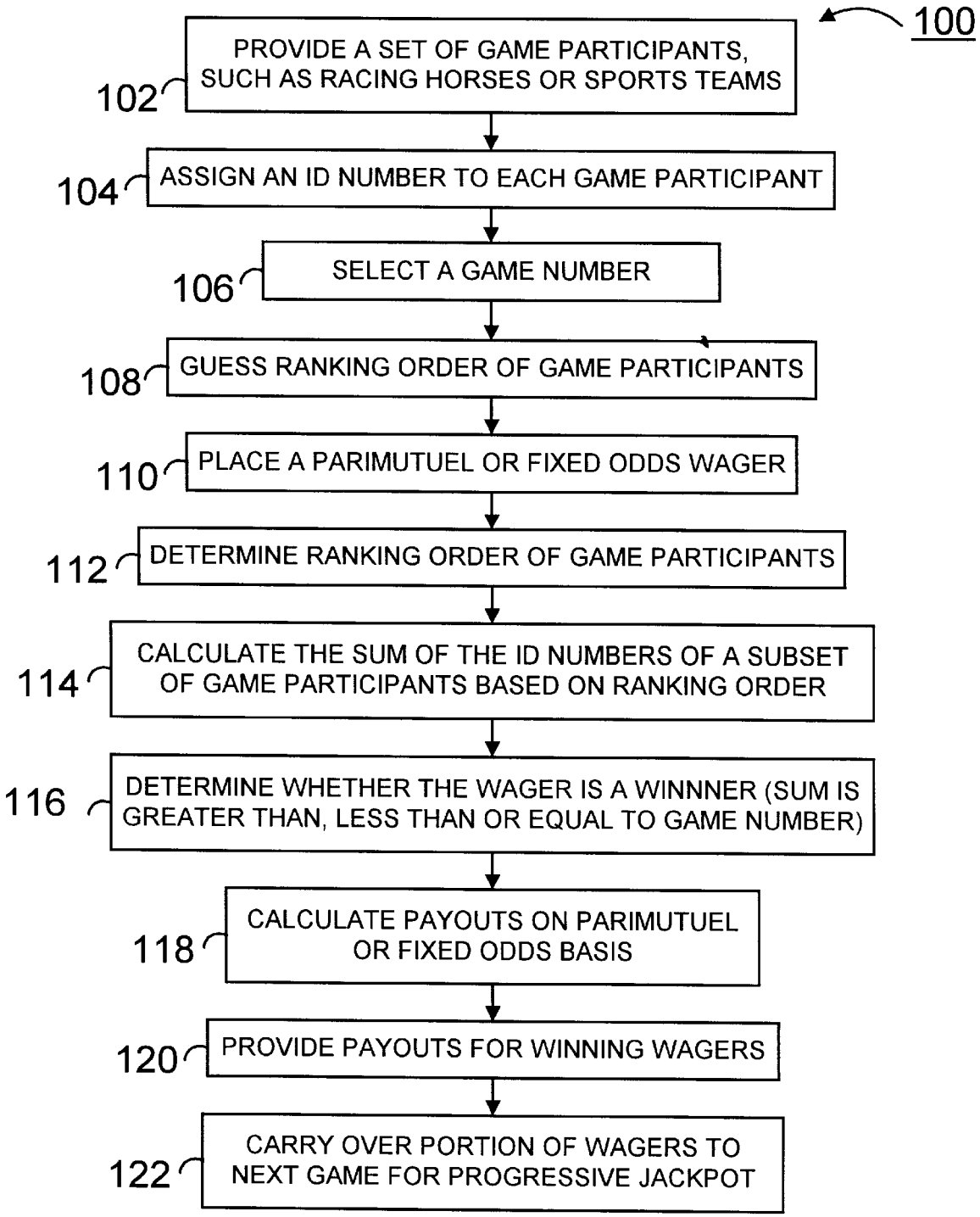
FIG. 2 is a flow chart showing a method of playing the wagering game of the present invention.

FIG. 2 shows a method 100 of playing the wagering game of the present invention. A set of game participants, such as racing horses or sports teams, is selected (step 102). Each of the game participants is assigned an identification number (step 104).

The wagering authority selects a game number 40 (step 106). Each player guesses what the ranking order will be for the game participants, e.g. for the racing horses or sports teams after the horserace or series of sporting events (step 108). Each player then places a wager based on the game number and the sum of the identification numbers of the game participants for a group of the game participants based on the player's guess as to the ranking order (step 110 ).

The ranking order of the game participants is then determined, e.g., by a horse race or a series of sporting events (step 112). The wagering authority calculates the sum of the identification numbers of a subset of the game participants based on the ranking order (step 114). For example, the subset may consist of the first three horses to win a horserace or the top three sports teams in a particular league. The wagering authority also determines whether the wagers placed are winning wagers by comparing the sum of the identification numbers of the subset of game participants to the game number, e.g., the sum may be greater than, less than or equal to the game number (step 116). Finally, the wagering authority calculates the payouts, e.g. on a parimutuel basis (step 118), and provides payouts for winning wagers (step 120).

In addition, if the game is played with a progressive jackpot, some portion of the total wagers placed is carried over to the next game in a series of such wagering games to increase the total prize money from which payouts to winning players are made (step 122), until a final game is played.

Figure 4:
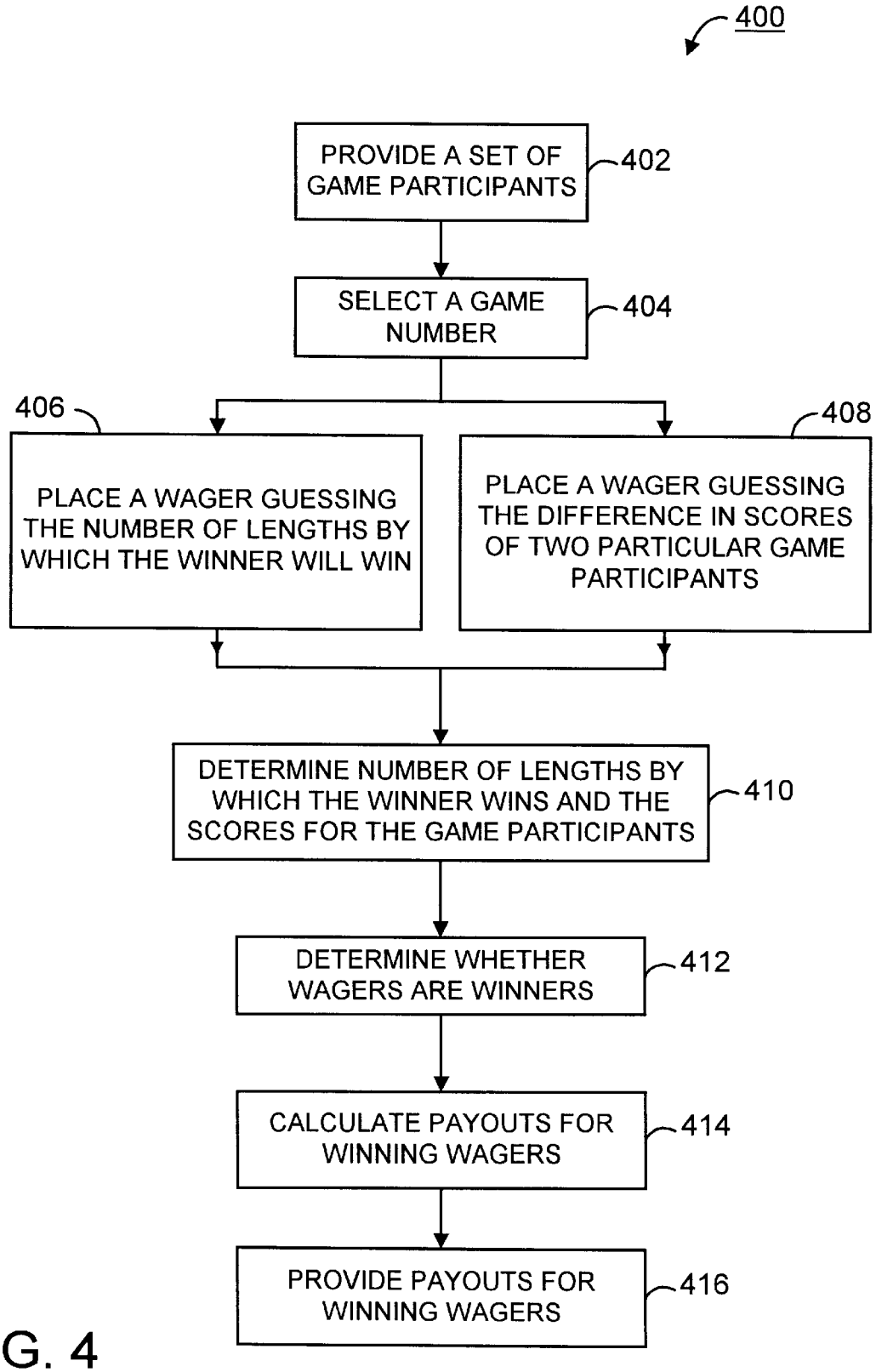
FIG. 4 is a flow chart showing another method of playing the wagering game of the present invention.

FIG. 4 shows another method 400 of playing the wagering game of the present invention. A set of game participants, such a racing horses, is selected (step 402). The wagering authority selects a game number 42 or 44 (step 404). In one type of game, each player places a wager and guesses whether the number of horselengths by which the winning horse will win the game is greater than, less than, or equal to game number 42 (step 406). In another type of game, each player places a wager and guesses whether the difference in the"scores" of two particular racing horses, e.g., the number of horselengths by which the second and third place horses are beaten to the finishing point by the first place racing horse, is greater than, less than, or equal to a game number 44 (step 408).

The number of horselengths by which the winning horse wins the game is then determined and the scores for each of the racing horses are determined, e.g., by conducting a horse race (step 410). The wagering authority determines whether the wagers placed by the individual players are winners (step 412), calculates the payouts (step 414), and provides payouts for winning wagers (step 416).

The wagering game of the present invention may be implemented as an electronic video or computer game to be played in a casino or other gaming establishment or even in a remote location, such as a player's home. The game may also be played via an electronic communications network, e.g., the internet.

Figure 3:
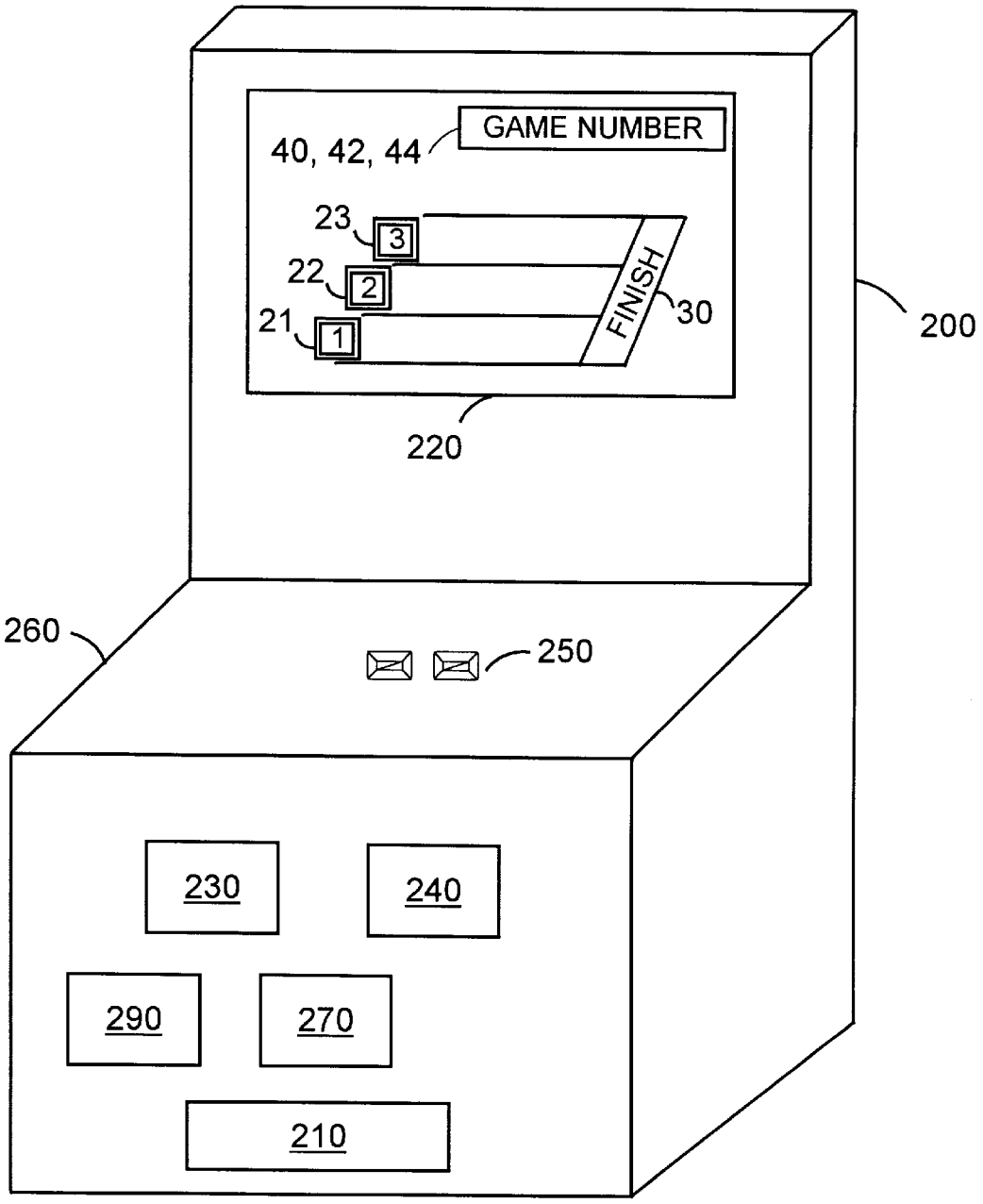
FIG. 3 is a somewhat diagrammatic sketch of an electronic gaming machine for playing the wagering game of the present invention.

As shown in FIG. 3, the electronic game may include a processor 210 in a game machine 200. The player views a screen 220 showing the game participants as identified by their identification numbers and the game number.

A player may play the wagering game of the present invention at game machine 200 by inserting a predetermined amount of money into a coin slot 230 or a bill collecting device 240. Once the predetermined amount of money has been inserted, the game commences and is displayed to the player on screen 220.

Before processor 210 causes the game participants to participate in an activity that determines their ranking order, such as a race, the player places a wager by pressing buttons 250 on a console 260 of game machine 200, or by touching a touch-sensitive screen 220. Processor 210 then conducts the ranking-order activity, and calculates the sum of the identification numbers of a subset, e.g. three, of the game participants selected on the basis of the rankingorder activity. Processor 210 may also determine whether the player's wager is a winning wager by comparing the sum to the game number.

In an alternative embodiment, processor 210 conducts the ranking-order activity and determines the length by which the first game participant reaches the finishing point before the second game participant and the scores for each of the game participants. Processor 210 then may also determine whether the player's wager is a winning wager by comparing the game number to the first game participant's winning length or the difference between the scores of any two other game participants.

If the player at game machine 200 has placed a winning wager, processor 210 may calculate the payout. The game machine 200 may either dispense the payout to the player through a payout dispenser 270 or credit an account maintained by processor 210 against which the player may play further games on game machine 200. Payouts determined on a parimutuel basis are possible when multiple players play the same game at similar game machines in communication with game machine 200. Communications between game machines may be accomplished, e.g., using a modem 290 in each game, machine 200 that may transmit data over the public telephone network.

Other embodiments are within the scope of the following claims.

What is claimed is:

1. A method of presenting one or more wagering games for play by a plurality of players, comprising:

selecting a set of game participants;

assigning an identification number to each of the game participants;

selecting a game number;

each of the plurality of players placing a wager relating to the game number, the sum of the wagers of the plurality of players being used to determine a total prize amount;

determining a ranking order of the game participants;

calculating the sum of the identification numbers of a subset of the game participants selected on the basis of the ranking order of the game participants;

determining whether the wager of each of the plurality of players is a winning wager by comparing the sum to the game number; and determining a payout for each winning player based on the total prize amount, including having a progressive jackpot such that a portion of the total prize amount of a first game is added to wagers made during a second subsequent game to determine a total prize amount for the second game.

2. The method of claim 1 wherein the subset includes at least two of the game participants.

3. The method of claim 1 wherein the payout is determined on a parimutuel basis.

4. The method of claim 1 wherein the payout is based on predetermined odds.

5. The method of claim 1 wherein the ranking order is determined by a race.

6. The method of claim 1 wherein the wager is that the sum is equal to the game number.

7. The method of claim 1 wherein the wager is that the sum is less than the game number.

8. The method of claim 1 wherein the wager is that the sum is greater than the game number.

9. A method of presenting a wagering game for play by a player, comprising:

selecting a set of game participants to be ordered according to the finishing order of the participants with respect to a finishing point;

selecting a game number;

the player placing a wager relating to the game number;

determining the finishing order of the game participants;

determining a number of lengths by which a first ordered game participant beats at least one other ordered game participant to the finishing point;

determining whether the player's wager is a winning wager based on a comparison between the game number and the number of lengths.

10. The method of claim 9 wherein the at least one other ordered game participant is a second game participant to reach the finishing point.

11. The method of claim 9 further comprising providing a payout for a winning wager.

12. The method of claim 11 wherein the payout is determined on a parimutuel basis.

13. The method of claim 11 wherein the payout is based on predetermined odds.

14. The method of claim 11 wherein the game is played with a progressive jackpot such that a portion of a sum of wagers made during a first game is added to a sum of wagers made during a second subsequent game.

15. The method of claim 9 wherein the finishing order is determined by a race.

16. The method of claim 9 wherein the wager is that the number of lengths is equal to the game number.

17. The method of claim 9 wherein the wager is that the number of lengths is less than the game number.

18. The method of claim 9 wherein the wager is that the number of lengths is greater than the game number.

19. An electronic gaming device for playing a wagering game by a player, comprising:

a display device displaying a game number and a set of game participants;

an input device by which the player places a wager relating to the game number; and a processor connected to the display device and the input device for determining a finishing order of the game participants and a number of lengths by which a first ordered game participant beats at least one other ordered game participant to the finishing point;

wherein the processor determines whether the wager is a winning wager by comparing the number of lengths to the game number.

20. The electronic gaming device of claim 19 wherein the display device comprises a screen.

21. The electronic gaming device of claim 19 wherein the input device comprises buttons.

22. The electronic gaming device of claim 19 wherein the input device comprises a touch sensitive screen.

23. The electronic gaming device of claim 19 wherein the gaming device is connected to other gaming devices for parimutuel wagering.

24. The electronic gaming device of claim 19 wherein the processor calculates a payout to the player for a winning wager and provides the payout.

25. The electronic gaming device of claim 24 wherein the payout is determined on a parimutuel basis.

26. The electronic gaming device of claim 24 wherein the payout is based on predetermined odds.

27. The electronic gaming device of claim 24 wherein the payout calculated by the processor includes a progressive jackpot such that a portion of a sum of wagers made during a first game is added to a sum of wagers made during a second subsequent game.

28. The electronic gaming device of claim 19 wherein the finishing order is determined by a race.

29. The electronic gaming device of claim 19 wherein the wager is that the number of lengths is equal to the game number.

30. The electronic gaming device of claim 19 wherein the wager is that the number of lengths is less than the game number.

31. The electronic gaming device of claim 19 wherein the wager is that the number of lengths is greater than the game number.

* * * * *